United States Patent [19]

Carini

[11] 4,303,120

[45] * Dec. 1, 1981

[54] CONTINUOUS CASTING MOLD FLUX POWDERS

[75] Inventor: George F. Carini, Penn Hills, Pa.

[73] Assignee: The Clay Harden Company, Pittsburgh, Pa.

[ * ] Notice: The portion of the term of this patent subsequent to Feb. 26, 1997, has been disclaimed.

[21] Appl. No.: 124,343

[22] Filed: Feb. 25, 1980

Related U.S. Application Data

[63] Continuation-in-part of Ser. No. 874,024, Feb. 1, 1978, Pat. No. 4,190,444.

[51] Int. Cl.[3] ..... B22D 11/00; C22B 9/10

[52] U.S. Cl. ..... 164/472; 164/473; 75/257; 75/53

[58] Field of Search ..... 164/55, 56, 73, 82; 75/257, 129, 53–58

[56] References Cited

U.S. PATENT DOCUMENTS

| | | | |
|---|---|---|---|
| 3,320,052 | 5/1967 | Bowden | 75/55 X |
| 3,704,744 | 12/1972 | Halley et al. | 164/82 |
| 3,708,314 | 1/1973 | Kisnide et al. | 164/73 X |
| 3,937,269 | 2/1976 | Salvadore et al. | 164/73 |
| 4,190,444 | 2/1980 | Carini | 164/73 X |

*Primary Examiner*—R. L. Spruill
*Assistant Examiner*—K. Y. Lin
*Attorney, Agent, or Firm*—Webb, Burden, Robinson & Webb

[57] ABSTRACT

This invention relates to mold flux powders for the continuous casting of steel. The mold flux powders comprise a plurality of sequential melting systems forming successive melts each of which assimilates the ingredients of the next system into the melt. In this way, the desired fludity is achieved in the mold flux at a rate required by the particular continuous casting process in which the flux is being used without resorting to an excessively low melting flux. At least one of the systems comprises a finely-divided glass.

7 Claims, No Drawings

CONTINUOUS CASTING MOLD FLUX POWDERS

RELATED APPLICATION

This application is a continuation-in-part of Application Ser. No. 874,024, filed Feb. 1, 1978, now U.S. Pat. No. 4,190,444 having the same title.

BACKGROUND

The importance of providing proper flux over the molten metal surface in a continuous casting mold is apparent from the numerous patents which have issued relating to the subject. See U.S. Pat. Nos. 3,970,135; 3,964,916; 3,949,803; 3,937,269; 3,926,246; 3,899,324; 3,891,023; 3,788,840; 3,718,713; 3,708,314; 3,704,744; 3,685,986; 3,677,325; 3,649,249; 3,642,052; 3,607,234; 3,318,363; 3,052,936; 2,825,947.

Much of the prior art focuses on softening point and fluidity of the melted fluxes. Little consideration has been given to rates; that is, the rate at which the mold flux powder melts sufficiently to spread and the rate at which the mold flux powder achieves its final desired fluidity so that it can be carried out of the mold in the space between the billet, bloom or slab being cast and the mold walls. If a mold flux remains over the surface of the metal in the mold too long, it either picks up too much of the deoxidation product it is designed to scavenge, and therefore loses fluidity, or it becomes so loaded with these products that it cannot pick up additional deoxidation products which it is supposed to remove. Certain prior art fluxes actually "iced over" in the mold, due to low tolerance to deoxidation products, e.g., alumina. Some consideration has been given to the rates at which the deoxidation products are taken into the molten flux, but the reasoning has been superficial. The important consideration is the rate of removal of the deoxidation products from the mold. This rate is controlled not only by the rate at which the deoxidation products are taken into the melt, but also the fluidity tolerance of the melt to dissolved deoxidation products and the rate at which the loaded flux is removed from the mold. Either rate can be controlling and, of course, they are usually interrelated.

Because numerous types of grades of steels are being continuously cast, i.e., stainless steel, high-carbon steel, low-carbon steel, aluminum-killed steel, etc., all at different temperatures and different casing rates the continuous caster must have available a range of flux compositions which will have a softening point and fluidity compatible with the particular product and casting rate. If a mold flux is too fluid or becomes fluid too fast, it will be carried away from the mold at a higher rate than desirable. The drawback to the too rapid removal of mold flux from the mold is the resultant decrease in surface quality of the cast shape and the need for larger amounts of mold flux powder to be spread over the mold during casting. These, of course, are important economic considerations.

In the past, casting fluxes having lower melt point temperatures and greater fluidity than necessary have sometimes been adopted simply because this was the only means of achieving sufficiently rapid melting, spread, and solubility for deoxidation products. Applicant provides a mold flux which has a controlled rate of fusion, rapid spread, intermediate fluidity, and high tolerance to dissolved deoxidation products which does not adopt low melt and/or softening point temperatures simply to provide the desired rate of melting, spread, and removal of deoxidation products.

SUMMARY OF THE INVENTION

This invention relates to a mold flux powder useful for continuous casting of numerous steel grades and which is devised to provide exceptional casting surfaces in various steels including, for example, aluminum-killed steels which are known to be particularly difficult to cast. The following table sets forth the ranges of the preferred compositions. Within these ranges, as explained herein in detail, the composition can be varied to provide the desired softening point and fluidity.

TABLE I

| Batch Ingredients | Weight Percentage |
|---|---|
| Portland Cement and Whiting | 50 to 80 |
| Fluorspar, Cryolite and Sodium Fluoride | 10 to 30 |
| Glass or Glass Mixture (softening points 1200 to 2000° F.) | 10 to 30 |
| Sodium Nitrate | up to 1 |

Preferred compositions comprise from no whiting up to a mixture of whiting and Portland Cement in a ratio of up to about 0.5 (whiting to Portland Cement). Whiting is natural or synthetic calcium carbonate. Whiting may be replaced in whole or in part by quick lime. Portland Cement is essentially tricalcium silicate (3 $CaO—SiO_2$). Partial substitution of barium carbonate for whiting is permissible and may even be desirable in certain applications.

Preferably the lime to silica weight ratio is greater than 2.3:1 considering the ingredients of the entire batch.

The preferred glass comprises, in weight percent, $Na_2O$— 8 to 18; $K_2O$— up to 8; $B_2O_3$— 15 to 25; $SiO_2$— 20 to 35; $F_2$— 4 to 8; CaO— 10 to 15; and BaO— 10 to 15. The softening point temperature of the lower temperature melting glass or mixtures of glass should preferably be between 1300° and 1800° F. Workable glass compositions, comprise, in weight percent, $Na_2O$— 8 to 25; $K_2O$— 0 to 8; $B_2O_3$— 0 to 25; $SiO_2$— 20 to 75; $F_2$— 0 to 12; CaO— 10 to 30; MgO— 0 to 3; BaO— 0 to 15; and $Al_2O_3$— 0 to 3.

The compositions set forth in the above table are comprised of at least three and sometimes four fluxing systems which sequentially melt and act to flux (promote melting) of the next system. In actual use, the sodium nitrate melts almost immediately and in addition to its fluxing effect on other components, serves to provide a certain tackiness to the remaining ingredients to minimize dusting in the mold.

The next system of ingredients to melt is the glass. The melting point and amount of glass (or mixture of glasses) may be selected to provide the desired rate of melting. This glass or mixture of glasses is perhaps the most significant ingredient for achieving the desired melting rate for the overall flux powder system.

After and to some extent during the melting of the glass, the fluorine containing compounds, i.e., fluorspar, cryolite and sodiium fluoride, which are present in a low melting relationship react and melt. Finally, the melt comprising the ingredients of the glass and fluorine compounds take the Portland Cement or Portland Cement/whiting system into solution. The lime is added to the overall composition so that the lime-silica ratio of the melted flux promotes with sodium and fluorine the solution of deoxidation products, for example, alumina where the steel being cast is aluminum-killed steel. The final flux composition depends upon a number of factors, for example, the residence time of the flux over the metal and the particular type of metal being cast. Hence, the final melted flux composition is determined not only by the composition of the mold powder but by the presence of deoxidation products which the mold flux is designed to dissolve and to remove.

DESCRIPTION OF THE PREFERRED EMBODIMENTS

Mold flux powders were prepared. In these examples, Glass A, Glass B, and Glass C have softening point temperatures of 1300°, 1400°, and 1800° F. respectively. The chemical analyses of Glasses A, B, and C are given in the following table, along with the chemical analysis of a Portland Cement which has been found suitable for the practice of this invention. The percentages are by weight.

TABLE II

| | Glass A | Glass B | Glass C | Portland Cement |
|---|---|---|---|---|
| $Na_2O$ | 15.5% | 9.0% | 13.83% | |
| $K_2O$ | 5.61 | 5.55 | 0.57 | |
| $B_2O_3$ | 20.45 | 20.23 | | |
| $SiO_2$ | 25.60 | 32.74 | 72.15 | 29.5% |
| $F_2$ | 5.52 | 5.47 | | |
| CaO | 13.21 | 13.06 | 10.20 | 68.0 |
| MgO | | | 0.91 | |
| BaO | 14.11 | 13.96 | 0.12 | |
| $Al_2O_2$ | | | 2:12 | 2.5 |
| $Fe_2O_3$ | | | 0.11 | |

The glasses and Portland Cement analyses set forth in Table II are intended to be exemplary only. Other glass compositions and Portland Cements of similar composition would be expected to work well.

Within the compositional ranges disclosed herein, particularly suitable mold flux compositions were batched as follows:

TABLE III

| Example | I | II | III | IV | V |
|---|---|---|---|---|---|
| Glass B | 20 | 20 | 30 | 30 | 20 |
| Fluorspar | 10 | 10 | 10 | 10 | 20 |
| Portland Cement | 70 | 50 | 60 | 50 | 40 |
| Whiting | | 20 | | 10 | 20 |
| Sodium Nitrate | 1 | 1 | 1 | 1 | 1 |

The chemical analyses (excluding the small sodium nitrate addition) for examples set forth in Table III would be as set forth in the following Table IV.

TABLE IV

| Example | I | II | III | IV | V |
|---|---|---|---|---|---|
| CaO | 57.18 | 54.78 | 51.84 | 50.64 | 54.94 |
| $SiO_2$ | 27.20 | 21.30 | 27.53 | 24.58 | 18.35 |
| $Al_2O_3$ | 1.75 | 1.25 | 1.51 | 1.25 | 1.00 |
| $Fe_2O_3$ | 0.63 | 0.45 | 0.56 | 0.47 | 0.36 |
| $F_2$ | 5.78 | 5.78 | 6.28 | 6.28 | 10.49 |
| $B_2O_3$ | 4.03 | 4.03 | 6.00 | 6.00 | 4.03 |
| BaO | 2.78 | 2.78 | 4.14 | 4.14 | 2.78 |
| $Na_2O$ | 1.79 | 1.79 | 2.67 | 2.67 | 1.79 |
| $K_2O$ | 1.10 | 1.10 | 1.65 | 1.65 | 1.10 |
| LOI | 0.20 | 9.00 | 0.20 | 4.64 | 8.80 |

The batch ingredients of the above described mold fluxes are finely divided, say minus 60 mesh U.S. Standard and preferably minus 100 mesh.

The mold fluxes described above can be modified by the addition of boron yielding compounds and/or soda yielding compounds such as powdered borax, anhydrous borax, boric acid, anhydrous boric acid, sodium nitrate, soda ash, sodium fluoride, etc. to increase fluidity and to lower the fusion temperature. Flake graphite may also be added to the mold flux powder where it is desired to have a reducing atmosphere in and about the mold flux.

Within the framework of the basic compositional range set forth in Table I, mold flux powders having softening point temperatures between about 1800° F. and 2200° F. have been demonstrated. The softening point temperatures can be shifted up or down in the range by changing the blend of glasses, increasing or decreasing the amount of glass by varying the ratio of fluorspar to sodium fluoride or by the addition of ingredients such as borax, boric acid, anhydrous boric acid.

Having thus described my invention with the detail and particularity required by the Patent Laws, what is desired protected by Letters Patent is set forth in the following claims:

1. In the continuous casting of steel wherein the steel is teemed from a tundish to a continuous casting mold, the improvement comprising introducing to said mold during teeming, a mold flux powder, consisting essentially of, in weight percent, at least three sequentially melting systems, the first system comprising 10 to 30 percent of one or more glasses having softening point temperature between 1200° and 2000° F., the second system comprising 10 to 30 percent cryolite, fluorspar, sodium fluoride and mixtures thereof, the third system comprising 40 to 80 percent of a mixture of Portland Cement and whiting, the weight ratio of whiting to Portland Cement in the mold flux powder being up to about 0.5, whereby the fusion point, rate of fusion and fluidity can be tailored to a particular continuous casting process involved.

2. In the continuous casting of steel wherein the steel is teemed from a tundish to a continuous casting mold, the improvement comprising introducing to said mold during teeming, a mold flux powder, consisting essentially of, in weight percent, at least three sequentially melting systems, the first system comprising 10 to 30 percent of one or more glasses having softening point temperatures between 1200° and 2000° F., the second system comprising 10 to 30 percent fluorspar, and the third system comprising 40 to 80 percent of a mixture of Portland Cement and whiting, the weight ratio of whiting to Portland Cement in the mold flux powder being up to about 0.5, whereby the fusion point, rate of fusion and fluidity can be tailored to the particular continuous casting process involved.

3. The process of claim 2 wherein the glass or glasses in the mold flux have a softening point between 1200° and 1800° F.

4. The process of claims 1, 2, or 3 wherein the glass or glasses in the mold flux powder analyses, by weight percent, $Na_2O$— 8 to 18; $K_2O$— up to 8; $B_2O_3$— 15 to 25; $SiO_2$— 20 to 35; $F_2$— 4 to 8; CaO— 10 to 15; and BaO— 10 to 15.

5. The process of claim 1, 2 or 3 wherein the glass or glasses in the mold flux powder analyses, by weight percent, $Na_2O$— 8 to 25; $K_2O$— 0 to 8; $B_2O_3$— 0 to 25; $SiO_2$— 20 to 75; $F_2$— 0 to 12; CaO— 10 to 30; MgO— 0 to 3; BaO— 0 to 15; $Al_2O_3$— 0 to 3.

6. The process of claim 1, 2 or 3 wherein the lime to silica weight ratio is greater than 2.3:1.

7. A composition of matter useful as a flux consisting essentially of, by weight 40 to 80 percent of a mixture of whiting and Portland Cement in a weight ratio up to about 0.5, 10 to 30 percent of fluorspar, cryolite and sodium fluoride and mixtures thereof, 10 to 30 percent by weight of one or more glasses, said glasses analyzing, by weight percent $Na_2O$— 8 to 25; $K_2O$— up to 8; $B_2O_3$— 0 to 25; $SiO_2$— 20 to 75; $F_2$— 0 to 8; CaO— 10 to 30; BaO— 0 to 15; and $Al_2O_3$— 0 to 3.

* * * * *